US006135665A

United States Patent [19]

Alfieri et al.

[11] Patent Number: 6,135,665

[45] Date of Patent: Oct. 24, 2000

[54] CLAMP FOR RAILROAD COUPLER HEAD

[75] Inventors: Richard P. Alfieri, Delmont; Daniel R. Disk, Murrysville, both of Pa.; Detlev F. Smith, Fairlawn; Roger H. Ramsey, Akron, both of Ohio

[73] Assignee: Union Switch & Signal, Inc., Pittsburgh, Pa.

[21] Appl. No.: 08/967,679

[22] Filed: Nov. 10, 1997

[51] Int. Cl.[7] ..... F16C 11/00

[52] U.S. Cl. ..... 403/61; 403/322.1; 403/385; 73/855; 213/77

[58] Field of Search ..... 403/61 OR, 321, 403/323, 322.1, 322.3, 385; 73/129, 856, 855, 857; 213/78, 79, 77; 248/220.21, 222.14, 222.51, 222.13, 231.21

[56] References Cited

U.S. PATENT DOCUMENTS

| | | | |
|---|---|---|---|
| D. 236,153 | 7/1975 | Hogg et al. | D15/140 |
| 2,355,544 | 8/1944 | McGowan . | |
| 4,487,060 | 12/1984 | Pomeroy . | |
| 4,520,662 | 6/1985 | Schmid . | |
| 4,592,217 | 6/1986 | Fernandez et al. . | |
| 4,665,858 | 5/1987 | Harrigal et al. | 116/30 |
| 4,691,563 | 9/1987 | Martin . | |
| 4,747,302 | 5/1988 | Goss . | |
| 4,876,885 | 10/1989 | Martin et al. . | |
| 5,131,269 | 7/1992 | Blosnick et al. . | |
| 5,176,350 | 1/1993 | McQuistian . | |
| 5,235,849 | 8/1993 | Egerton . | |
| 5,287,739 | 2/1994 | Kingsbury . | |
| 5,758,870 | 6/1998 | Weaver | 269/329 |

*Primary Examiner*—Lynne H. Browne
*Assistant Examiner*—Kenneth Thompson
*Attorney, Agent, or Firm*—David V. Radack; David C. Jenkins; Eckert Seamans Cherin & Mellott, LLC

[57] ABSTRACT

A clamp for securing apparatus such as end-of-train equipment to a railroad coupler head includes a first finger member that is mounted to pivot about a pivot pin in scissors-like manner between a fixed second and third finger member affixed to a housing, a threaded rod and cooperating piston for pivoting the first finger member away from the fixed second and third finger members, a rail member for abutting against an outside surface of the coupler head, and a crank and handle for tightening the grip of the first, second and third fingers on the inner surfaces of the core hole when the crank is rotated. The pivoting of the first finger member is accomplished by driving a pin through a slotted clevis defined in a first end of the first finger member, such that the pin moves within the slot defined by the clevis when the pin is driven in one lateral direction generally toward the fixed second and third finger members, thereby urging the clevis downward about the pivot pin and urging the opposing second end of the first finger member to move upwardly away from the fixed second and third finger members. In a preferred embodiment, end-of-train signaling and monitoring equipment is connected to the clamp for the railroad coupler head.

20 Claims, 6 Drawing Sheets

CLAMP FOR RAILROAD COUPLER HEAD

BACKGROUND OF THE INVENTION

1. Field of the Invention

The present invention is generally related to a clamp which secures apparatus, such as an end-of-train marker light and telemetry equipment, to the coupler head of the last car in a train and, more particularly, to a railroad coupler clamp which secures equipment to the guard arm side of a coupler head.

2. Description of the Related Art

As is well known in the art, apparatus such as end-of-train signaling equipment is commonly used to meet modern railroad operating and safety requirements. Various train operating parameters (e.g., brakeline pressure, and the like) are remotely monitored by the end of train equipment, and telemetered to an engineer in the locomotive cab. In addition, the end-of-train equipment can include a marker light to identify the end of the train.

Over the years, several railroad coupler mount configurations have been devised for securing the end-of-train signaling and monitoring equipment to the coupler head of the last car in a train. U.S. Pat. Nos. 2,355,544 to McGowan and 4,487,060 to Pomeroy show signaling and monitoring equipment positioned inside the coupler head. Positioning the equipment within the coupler head is not ideal since it can be damaged by accidental mating with a coupler of another car, a situation which is likely in an active yard. Moreover, pusher locomotives cannot be connected without first removing the equipment. U.S. Pat. No. 4,592,217 to Fernandez et al. shows mounting the equipment on top of the coupler head by using a flag hole. This arrangement avoids accidental equipment damage; however, the arrangement has the disadvantage that not all coupler heads include a flag hole.

In the related art, most railroad couplers used in the United States and Canada are cast with four relief holes, or core holes, in the guard arm side of the coupler head. FIG. 1 shows a typical coupler head 10, used in the United States and Canada with two uppermost core holes 12*a–b* which are spaced vertically from two lowermost core holes 14*a–b* formed in the guard arm side. The core hole pairs, 12*a–b* and 14*a–b* respectively, are interconnected to provide passages underneath central region 16 and are divided from each other by a rib 18. The core holes 12*a–b* and 14*a–b* were not originally designed to serve any function on the finished coupler head 10; rather, they facilitated casting. Nevertheless, the industry has recognized that the core holes are good locations for securing end-of-train signaling and monitoring equipment and several railroad coupler mounts have been devised which take advantage of them. For example, U.S. Pat. No. 4,520,662 to Schmid shows a coupler mount with four opposing jaw members which grip within the four core holes 12*a–b* and 14*a–b* in the coupler head 10. The disadvantage of the Schmid device is that it is heavy and complicated and, therefore, difficult for a single person to install on the coupler head 10. U.S. Pat. No. 4,691,563 to Martin et al. and U.S. Pat. No. 4,876,885 to Martin et al. each describe railroad coupler mounts which include a banana-shaped arm that extends through a core hole pair 12*a–b* or 14*a–b*, respectively. Further, U.S. Pat. No. 5,235,849 to Egerton shows a railroad coupler mount that includes a hook for contacting the inside upper lip of a coupler head within a single coring hole, a jaw member which engages the rib between a pair of coring holes, a pad for abutting against an outside surface of the coupler head, and a handle for orienting the hook in the transverse or upright positions. However, in some instances where the core hole is small, the Egerton device has the drawback that the end-of-train equipment may not be temporarily hooked within that small single coring hole of the coupler head. In particular, if the hole is small enough to require that the hook be oriented in a substantially horizontal position in order to insert the hook within the hole, then the hook must first be rotated to temporarily hook within the hole prior to final tightening. While the Martin et al. and Egerton devices are easier to mount, there is still a need for alternative railroad coupler mounts which provide easy yet secure clamping of the end-of-train signaling and monitoring equipment from with the core holes in the coupler head of the last car of the train. In particular, a need exists for an alternative coupler mount which is easily transported and installed by one person and which may hang temporarily from within a randomly sized core hole prior to tightening during installation.

SUMMARY OF THE INVENTION

It is therefore an object of the invention to provide a clamp which can be secured to the guard arm side of the railroad coupler head using only the inner surfaces of an uppermost of a pair of core holes while abutting against at least one outside surface of the coupler head.

It is a feature of the present invention to provide a scissors-like clamp that is narrow in a non-engagement position and widens as a first finger-like member of the clamp is pivoted away from a second finger-like member of the clamp, thereby to grip opposing inner surfaces of the uppermost core hole.

It is another feature of the present invention to provide means for laterally driving a pin through a clevis defined by a pivotally mounted finger member, thereby to pivot the finger member in a scissors-like manner.

In accordance with a preferred embodiment of the present invention, a clamp for securing apparatus such as an end-of-train device to a railroad coupler head has a first finger member that is pivotally mounted between a fixed second and third finger member such that the first finger member may be pivoted away from the fixed second and third finger members in a scissors-like manner, thereby to grip inner surfaces of a core hole, by increasing the distance between the first finger member and the fixed second and third finger members while all three finger members are inserted within the core hole. The pivoting of the first finger member is accomplished by driving a pin through a clevis that defines a slot in a first end of the first finger member, such that the pin moves within the slot when the pin is driven in one lateral direction generally toward the fixed second and third finger members, thereby causing the clevis to move downwardly about the pivot and causing the second end of the first finger member to move upwardly away from the fixed second and third finger members.

Briefly described according to another preferred embodiment, a clamp for securing equipment to a railway coupler head, the railway coupler head having pre-existing core holes in the side thereof, at least two of the core holes being spaced vertically from each other and having a rib therebetween, said clamp comprising: a laterally extending finger member for insertion into an uppermost of the core holes, the laterally extending finger member having a lower abutting surface for resting atop the rib; mounting means on the finger member for mounting the laterally extending finger member to the equipment; a second finger member pivotally mounted to the laterally extending finger member through a first axis that extends substantially perpendicularly through the laterally extending finger member and the second finger member, thereby to movably extend the second finger member from the first axis; the second finger member having an upper abutting surface for contacting a portion of the uppermost of the core holes; and urging means for forcibly urging the second finger member into forcible contact with the portion of the uppermost of the core holes when the laterally extended finger member and the second finger member are inserted within the uppermost of the core holes.

An advantage of the present invention is that the railroad coupler clamp and attached end-of-train equipment may be momentarily and temporarily hung from within the core hole before the scissors-like finger members are tightened within the coring hole.

Another advantage of the present invention is that the simple design provides cost-effective manufacturing.

Another advantage of the present invention is that it is strong, compact, and lightweight.

Another advantage of the present invention is that it may be guided "sight unseen" by a user into a coring hole to provide secure mounting without viewing the coring holes during installation positioning, thereby minimizing the possibility of an insecure mounting in an inadequate coring hole.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
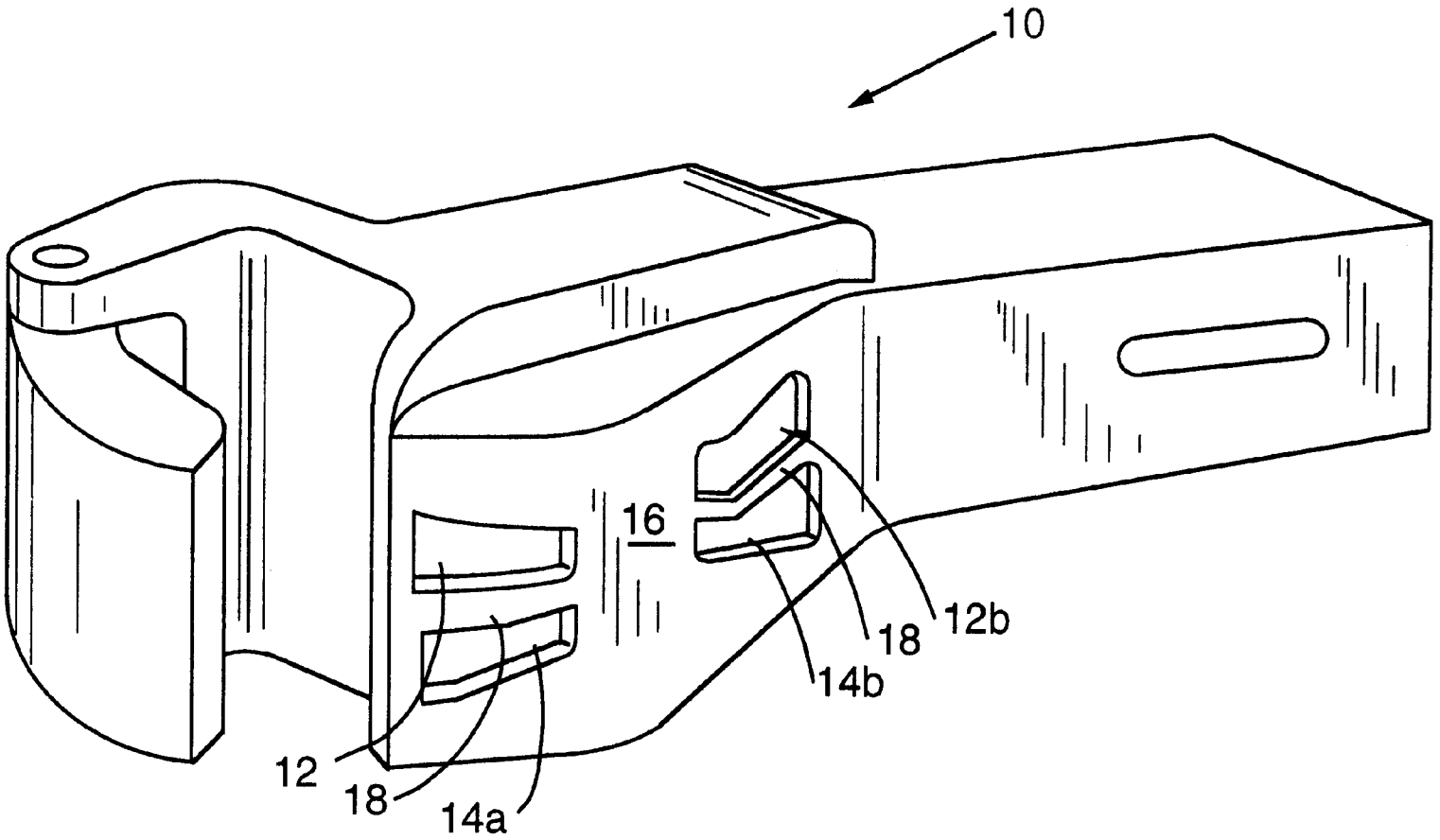
FIG. 1 Prior Art
FIG. 1 is an isometric view of a conventional railroad coupler head.

Referring now to the drawings, and more particularly to the side, top, and front views of FIGS. 2–5, a clamp 20 comprises a housing 22 on which finger members 24, 26 may fixedly be connected such that the finger members 24, 26 protrude substantially perpendicularly from the housing 22. Preferably, finger members 24 and 26 may be the same lengths, although finger members of different lengths may be used.

In a preferred embodiment, the finger members 24, 26 may extend from rails 25, 27 which extend upwardly along the housing 22, and through which screws 24*a*, 24*b* and 26*a*, 26*b* may pass, respectively, thereby to connect the finger members 24, 26 to the housing 22. These screws may be countersunk as shown. The rails 25, 27 may have sufficient length to contact and press against an outside surface 29*a* of an upper lip 29 of the uppermost core hole 12*a* (see FIG. 2), thereby providing stability of the clamp 20 when tightened against the coupler head 10. Similar rails 125, 127 may extend downwardly along the housing and may be affixed to the housing 22 with screws 124*a*, 124*b* and 126*a*, 126*b*, respectively. The rails 125, 127 may have sufficient length to contact and press against an outside surface 129*a* of a lower lip 129 of the lowermost core hole 14*a* (see FIG. 2), thereby providing stability of the clamp 20 when tightened against the coupler head 10.

Figure 5:
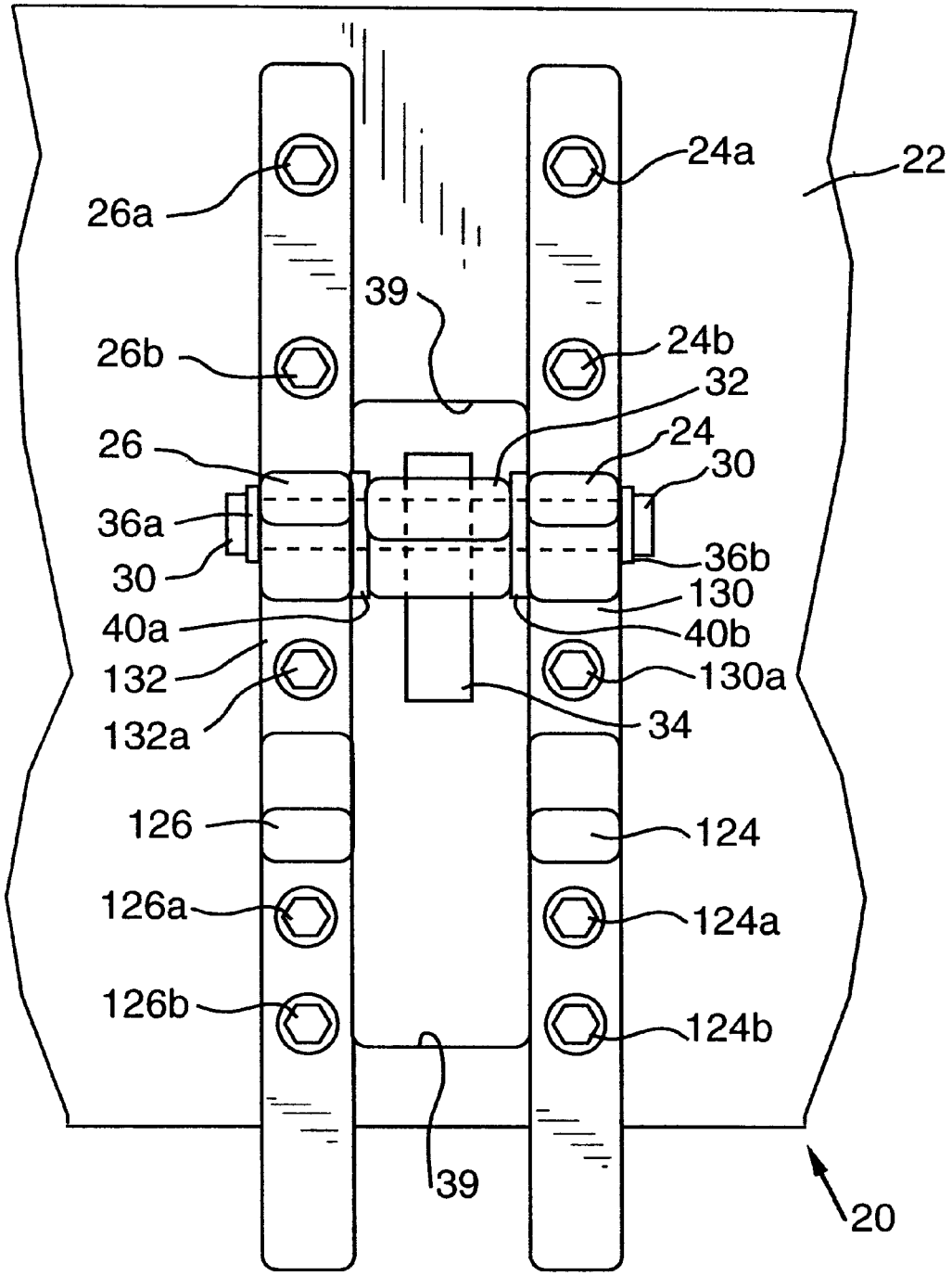
FIG. 5 is a front view of an alternate embodiment of the embodiment shown in FIG. 4.

As shown in FIG. 5, an alternate preferred embodiment utilizes a single rail 130 instead of rails 25 and 125, and a single rail 132 instead of rails 27 and 127. The single rails 130, 132 may be connected to the housing 22 with additional screws 130*a*, 132*a*, respectively. In one alternate embodiment, the single rails 130, 132 may contact the rib 18 at an outer surface 18*a*, and as such, they may be cut or molded substantially to the shape of the outer surface 18*a* (see FIG. 2), thereby to increase stability of the clamp 20 when tightened against the coupler head 10 by increasing surface area contact between the rails 130, 132 and the outer surface 18*a*.

Figure 2:
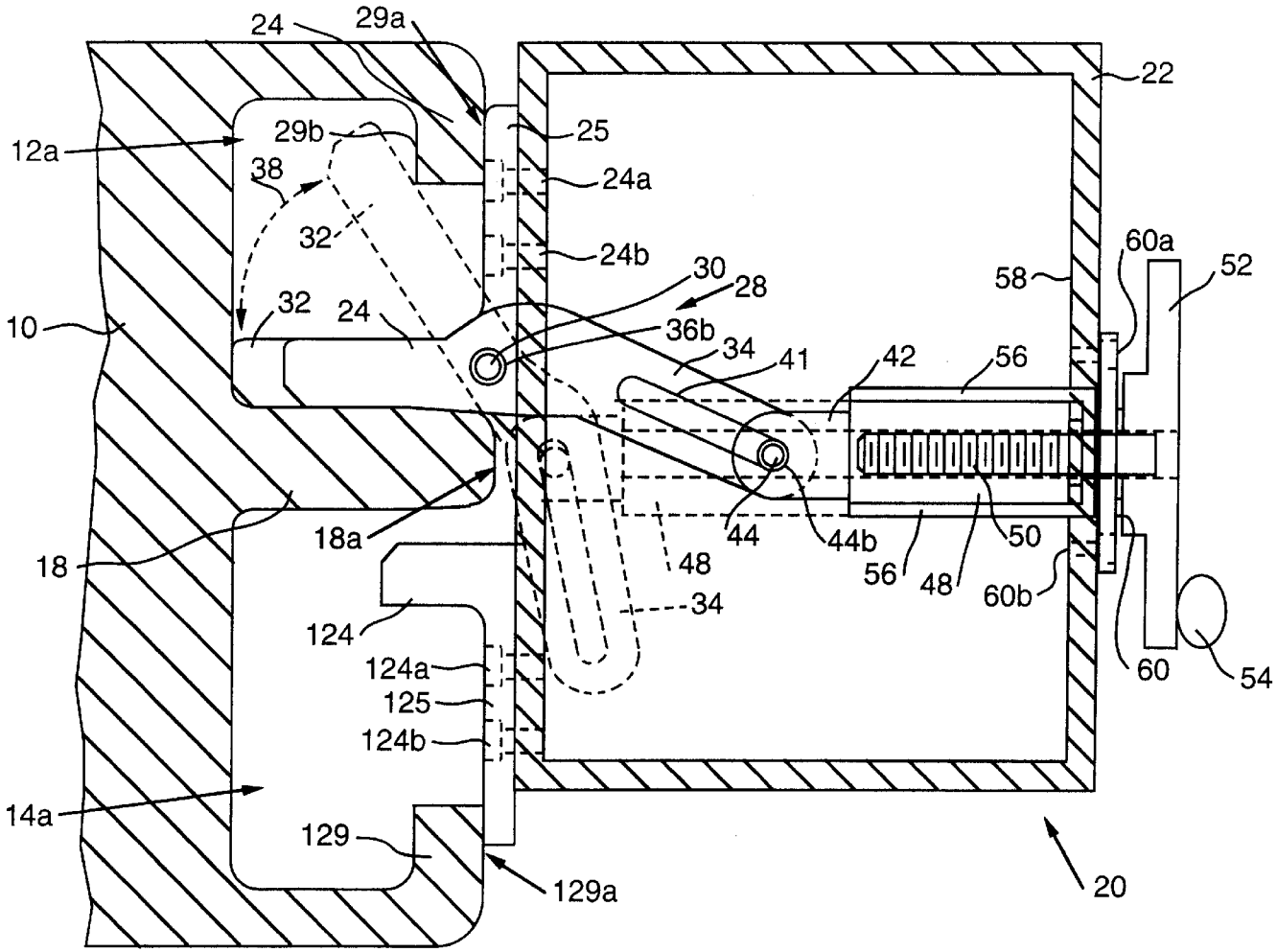
FIG. 2 is a cross-sectional side-view illustrating a railroad coupler head and a coupler head clamp having scissors-like means in cooperation with a threaded rod combination, for securing the clamp to the coupler head according to a preferred embodiment of the present invention.
Figure 4:
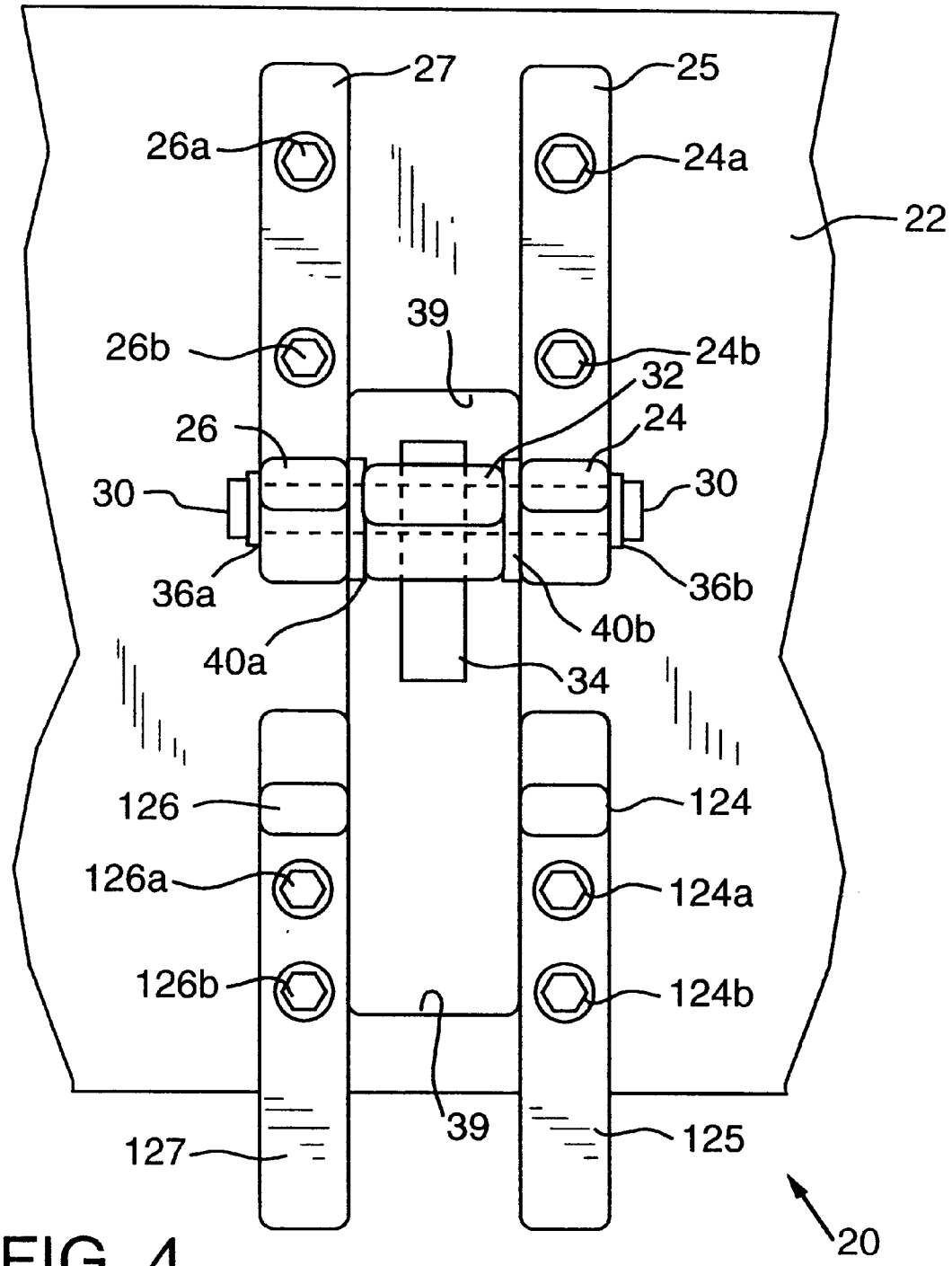
FIG. 4 is a front view of the scissors-like means for securing the railroad coupler head clamp that is shown in FIG. 2.

In a preferred embodiment, as shown in FIGS. 2 and 4, an obstacle finger 124, 126 may extend outwardly and substantially perpendicularly from the rails 125, 127, respectively. Similarly, as shown in FIG. 5, the obstacle fingers 124, 126 may extend outwardly and substantially perpendicularly from the rails 130, 132, respectively. Referring to FIG. 2, the obstacle fingers 124, 126 provide guidance in locating the lower core hole 14*a* for the purpose of preventing the finger members 24 and 26 from being inserted into and inadvertently being engaged within the lower core hole 14*a*. However, as shown in FIG. 2, the obstacle fingers 124, 126 provide no support against the rib 18 or within the core hole 14*a* when the finger members 24, 26 and 28 are positioned and engaged within the uppermost core hole 12*a*.

Figure 3:
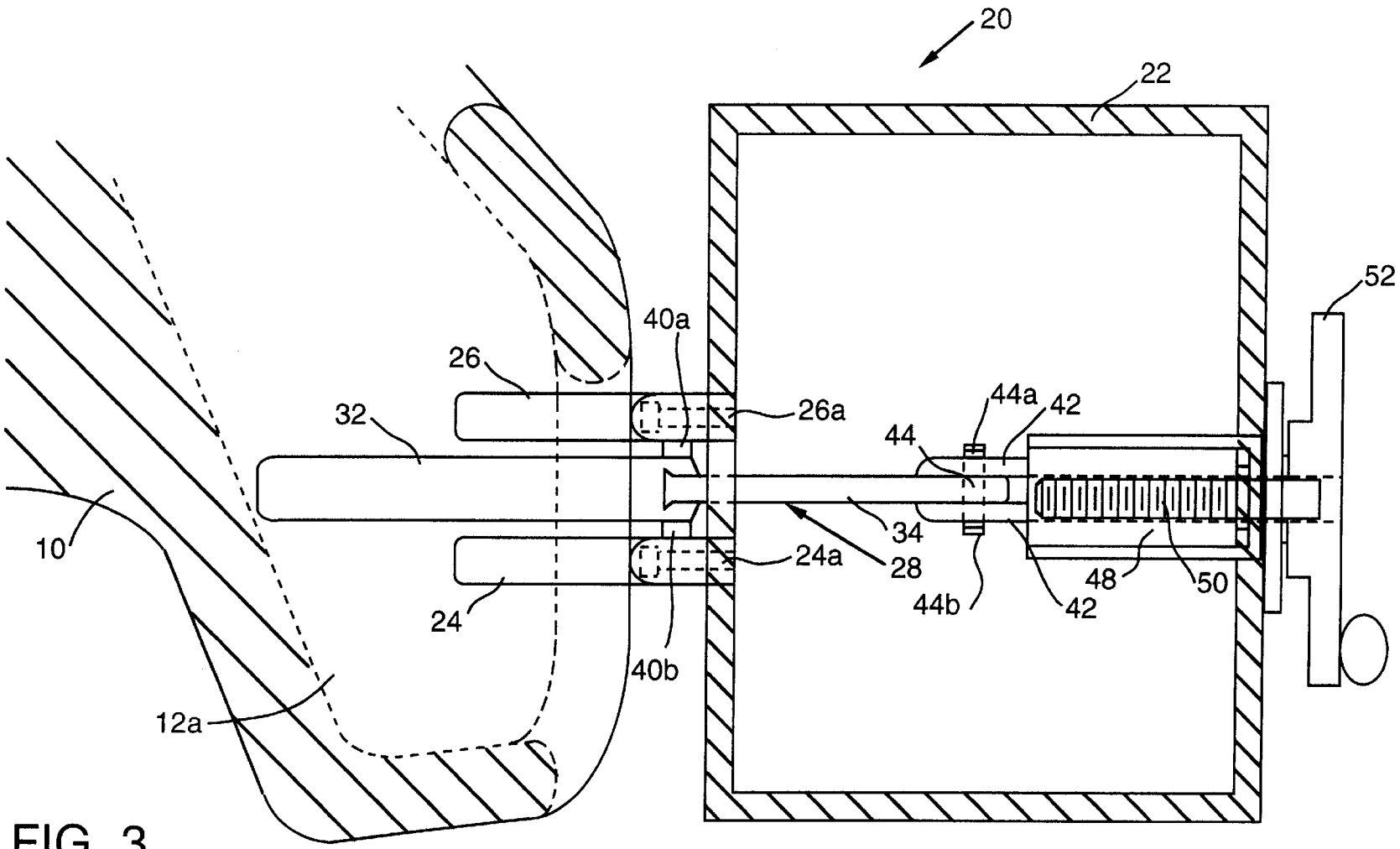
FIG. 3 is a cross-sectional top view of the railroad coupler head and coupler head clamp shown in FIG. 2.

A finger member 28 may be mounted to the housing 22 between the finger members 24 and 26 with a pivot pin 30 that extends through the finger member 24, then through finger member 28 between a finger end 32 and a clevis end 34, then through finger member 26. The pivot pin 30 preferably is held in place with retaining rings 36*a*, 36*b* or the like in a known manner (refer to FIGS. 2, 4 and 5). As such, the finger member 28 may pivot about the pivot pin 30 such that the finger end 32 may be moved in a scissors-like manner from a non-engagement position wherein the finger end 32 is substantially parallel to the finger members 24, 26, to an engagement postion wherein the finger end 32 forms an acute angle with the finger members 24, 26, as shown by the dotted arrow 38 in FIG. 2. As shown in FIGS. 3–5, spacers 40*a*, 40*b* or the like may encircle the pivot pin 30 between the finger members 24, 28 and 26, thereby to prevent binding of the pivotal movement of the finger member 28. As shown in FIGS. 4 and 5, the housing 22 defines an opening 39 through which the finger end 32 protrudes from the housing 22. The opening 39 is large enough to allow a portion of the clevis end 34 to protrude through when the finger end 32 is positioned away from the finger members 24, 26, as shown by the dotted line shadow of the finger end 32 and the clevis end 34 in FIG. 2.

The clevis end 34 may define a slot 41 through which a yoke 42 is coupled with a driving pin 44 that passes through the yoke 42 and the slot 41. As shown in FIG. 3, retaining rings 44*a*, 44*b* or the like may be used to retain the driving pin 44 substantially as described for the pivot pin 30. The yoke 42 is welded or otherwise fixedly connected to a piston 48 which is threaded to cooperate with a threaded rod 50. The threaded rod 50 is connected to a crank 52 with a handle 54 which may be rotated in order to rotate the rod. Depending on the rotation of the rod 50, the rod 50 drives the piston 48 and the yoke 42 outwardly away from the crank 52, as shown in FIG. 2 in dotted line shadow of piston 48 and the yoke 42, and inwardly toward the crank 52, as shown in FIG. 2 as a solid line drawing of the piston 48 and the yoke 42. The piston 48 may slide within a bearing sleeve 56 which may be fixedly connected to the housing 22 by welding or similar attachment to an interior surface 58. The bearing sleeve 56 may substantially encircle the piston 48 when the piston 48 is positioned inwardly toward the crank 52, thereby to protect the piston 48 from exposure to dirt and the like. In a preferred embodiment, a left-handed thread is contemplated for the rod 50 in cooperation with the piston 48, and a right-handed thread is contemplated for connecting the handle 52 to the rod 50. However, variations of these threads are intended to fall within the scope of this description. A covering plate 60 through which the threaded rod 50 passes may be attached to the housing 22 with screws 60*a*, 60*b* in order to provide support about threaded rod 50 that is connected to the crank 52.

While FIG. 2 shows the clamp 20 secured to the uppermost core hole 12*a* of the coupler head 10, it should be understood that the clamp 20 could easily be secured to the uppermost coring hole 12*b*, but that the present invention is not contemplated for mounting within the lowermost core holes 14*a* and 14*b*. All that is required to practice the invention is to have at least one fixed finger member which is inserted along with a pivotable finger member within an uppermost core hole 12*a* or 12*b*, wherein the fixed finger member 24 rests atop the rib 18 when the pivotable finger member 28 is pivoted to press against an inside surface 29*b* of the upper lip 29, which pivoting also forcibly urges at least one of the rails 25 and 27 into clamped contact against the outside surface 29*a* of the upper lip 29. Additionally, the molded rails 125, 127 may be forcibly urged into clamped contact against an outside surface 129*a* of a lower lip 129.

Figure 6:
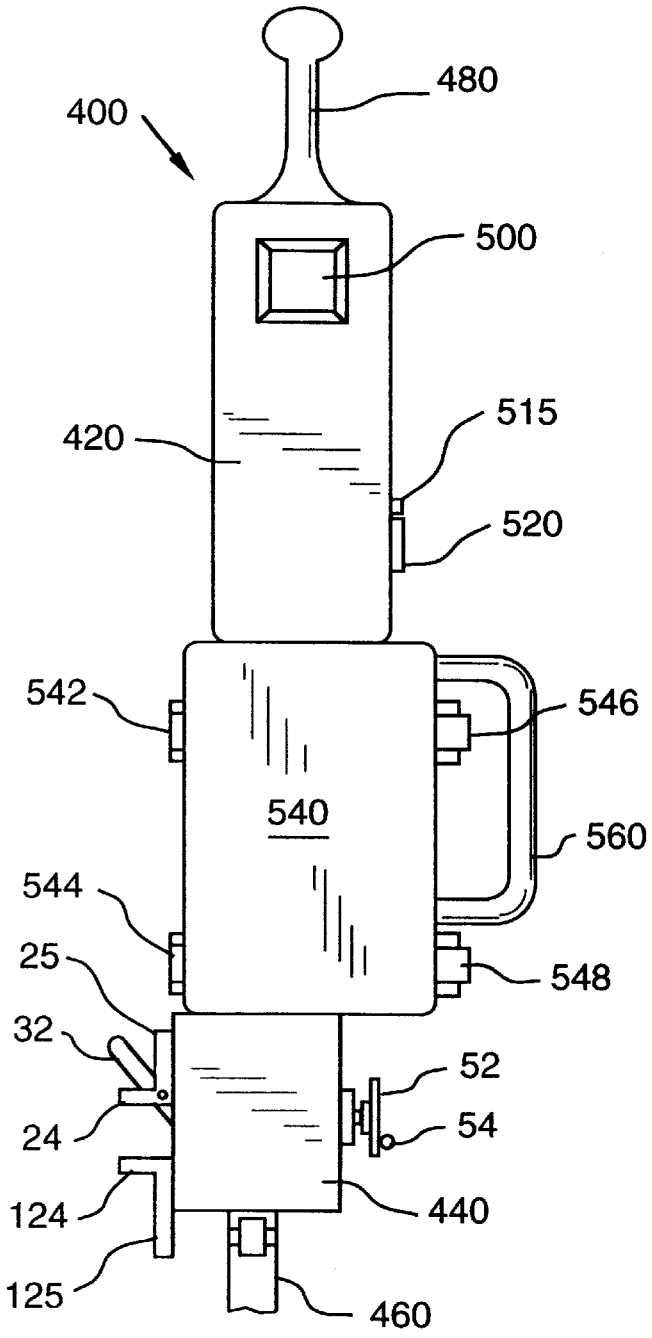
FIG. 6 is a front view of a preferred end-of-train signaling and monitoring equipment package which includes a clamp for a railroad coupler head according to the present invention.
Figure 7:
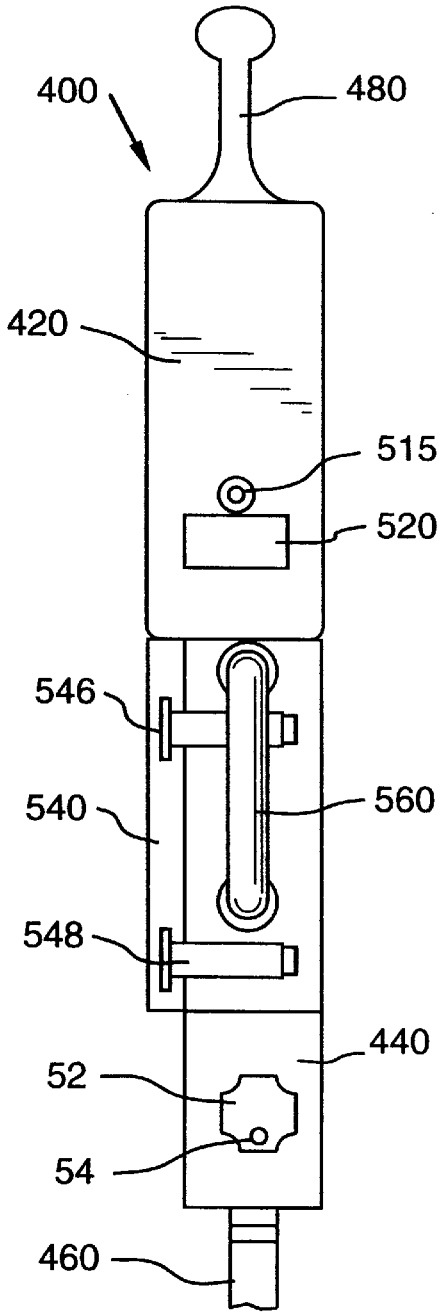
FIG. 7 is a side view of the package and clamp shown in FIG. 6.
Figure 8:
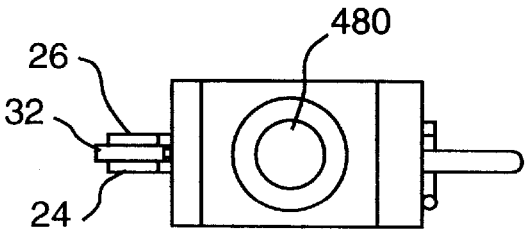
FIG. 8 is a top view of the package and clamp shown in FIGS. 6 and 7.

FIGS. 6, 7 and 8 illustrate a preferred end-of-train signaling and monitoring equipment package 400 which includes the signaling and monitoring equipment 420, a clamp 440, and hose connections 460. The signaling and monitoring equipment 420, the clamp 440, and hose connections can be part of one integral package 400 or can be separable in a manner which leaves the clamp 440 on the coupler head while the signaling and monitoring equipment 420 is transported elsewhere. The signaling and monitoring equipment 420 includes a radio antenna 480 for telemetering train operating information to an engineer in the locomotive cab, an end-of-train marker light 500, a test button 515, a display 520 for providing train operating information locally to train personnel at the site of attachment of the equipment 420 to the coupler head, and a battery compartment to which access is permitted by a battery door 540. The battery door 540 is hinged with hinges 542, 544, and is secured in a closed position with latches 546, 548. A carrying handle 560 connected to the signaling and monitoring equipment 420 is provided to allow a single person to transport and install the entire package 400.

2. Operation of the Preferred Embodiment

In operation, the signaling and monitoring equipment package 400 may be carried by one person with the handle 560. The streamlined design of the package 400 facilitates the carrying of the package similarly to the manner in which a common suitcase (not shown) is carried. The finger members 24, 26 and 28 may be positioned in the non-engagement position wherein the finger end of the finger member 28 is parallel to the finger members 24 and 26. In the non-engagement position, the clamp 440 and attached signaling and monitoring equipment 420 may be lifted by the handle 560 as a single package 400 to position the finger members 24, 26 and 28 within the top core hole 12*a*. The positioning may be accomplished without having the core hole 12*a* in view by utilizing the obstacle fingers 124, 126 to "feel" for the bottom core hole 14*a* while "feeling" for the upper core hole 12*a* with the finger members 24, 26 and 28. The obstacle fingers 124, 126 will prevent insertion of the finger members 24, 26 and 28 into the bottom core hole 14*a*, identifying for the user without seeing the core holes that the finger members 24, 26 and 28 have not yet located the uppermost core hole 12*a*.

When the finger members 24, 26 and 28 have been positioned within the coring hole 12*a*, the handle 54 may be used to rotate the crank 52 in order to rotate the threaded rod 50 which will drive the cooperating threaded piston 48 out of the bearing sleeve 56 and away from the crank 52. This lateral movement of the piston 48 drives the driving pin 44, which is connected to the piston 48 through the yoke 42, through the slot 41 defined by the clevis end 34 of the finger member 28. Since the bearing sleeve is fixedly attached to the inner surface 58 of the housing 22, the piston 48 and connected yoke and coupled driving pin will move laterally without moving upwardly or downwardly. As the driving pin 44 moves laterally through the slot 41 defined by the freely pivoting clevis end 34, the clevis end 34 is pivoted downwardly, thereby pivoting the finger end 32 upwardly away from the finger members 24 and 26, as shown in shadow in FIG. 2. The threaded rod 50 is rotated sufficiently to urge the finger end 32 against the inner surface 29*b* of the upper lip 29 while the fixed finger members 24 and 26 rest atop the rib 18 and while the rails 25 and 27 are pulled into clamped contact with the outer surface 29*a* of the upper lip 29. As the threaded rod 50 is rotated, the finger members 24 and 26 oppose the finger member 28 in scissors-like manner, thereby tightening the finger members 24, 26 and 28 within the core hole 12*a* in an engagement position to secure the grip of the finger members 24, 26 and 28 within the uppermost core hole 12*a*, particularly when stabilized by opposing contact of rails 25 and 27 against the upper lip of the core hole 12*a*. Additionally, the rails 125, 127 may be pulled against the outside surface 129*a* of a lower lip 129, thereby providing increased stability.

Prior to positioning the finger members 24, 26 and 28 within the uppermost core hole 12*a*, the handle may be rotated to position the finger end 32 in a partial engagement position whereby the finger end 32 is pivoted upwardly away from the finger members 24 and 26 only partially, so that the finger members 24, 26 and 28 nonetheless may be inserted into the uppermost core hole 12*a*. This partial engagement position will permit the clamp 20 to temporarily grip inside small and large core holes before the clamp is tightened, thereby permitting the user to release the temporarily mounted clamp 440 in order to facilitate rotation of the handle 54 during tightening of the clamp. This improvement generally is not available for small holes on some related art inventions which use a hook member within the core hole, because the gripping advantage of the hook must be relinquished initially in order to fit the hook within the small core hole.

The foregoing description is included to illustrate the operation of the preferred embodiment and is not meant to limit the scope of the invention. From the foregoing description, many variations will be apparent to those skilled in the art that would yet be encompassed by the spirit and scope of the invention. For instance, although preferred embodiments of the invention have been described in conjunction with three finger members pivoting in scissors-like manner, it will be understood that the principles of the invention may be extended to other scissors-like means, such as a first plurality of finger members that are pivotable upwardly or downwardly as a first group in a scissors-like manner from a second plurality finger members that, as a group are either fixed or movable relative to the first plurality of finger members. Further, although preferred embodiments of the invention have been described in conjunction with a threaded rod and cooperating piston for driving the driving pin 44 through the slotted clevis end 34, it will be understood that the principles of the invention may be extended to other means for driving the pivoting of the finger members, such as where the driving pin 44 is driven laterally through the slotted clevis end 34 with a lever instead of with the threaded rod and piston as described hereinabove. Further, it will be understood that the housing, all finger members, rails, threaded members and related items may be manufactured materials such as steel, aluminum, polymers, plastic, and similar materials that may be suitable for meeting the stresses associated with mounting the coupler clamp. Moreover, where screws are shown and described, it will be understood that the parts may be connected with bolts, welding, integral moldings and similar connection means that may be suitable for meeting the stresses associated with mounting the coupler clamp.

The preferred embodiment was chosen and described in order to best explain the principles of the present invention and its practical applications to those skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A clamp for securing equipment to a railway coupler head, the railway coupler head having pre-existing core holes in the side thereof, at least two of the core holes being spaced vertically from each other and having a rib therebetween, said clamp comprising:

a laterally extending finger member for insertion into an uppermost of the core holes, said laterally extending finger member having a lower abutting surface for resting atop the rib;

mounting means on said finger member for mounting said laterally extending finger member to the equipment;

a second finger member pivotally mounted to said laterally extending finger member through a first axis that extends substantially perpendicularly through said laterally extending finger member and said second finger member, thereby to move said second finger member from said first axis;

said second finger member having an upper abutting surface for contacting a portion of said uppermost of the core holes; and urging means for forcibly urging said second finger member into forcible contact with said portion of said uppermost of the core holes when said laterally extended finger member and said second finger member are inserted within said uppermost of the core holes.

2. The clamp according to claim 1, further comprising:

an upper head abutting surface on said mounting means for contacting a portion of the railway coupler head adjacent to but exterior to and above said uppermost of the core holes.

3. The clamp according to claim 2, further comprising:

a lower head abutting surface on said mounting means for contacting a portion of the railway coupler head adjacent to but exterior to and below said uppermost of the core holes.

4. The clamp according to claim 3, wherein said urging means comprises a threadable member rotatable about a second axis that is substantially perpendicular to said first axis.

5. The clamp according to claim 1, further comprising:

a third finger member connected to said mounting means and laterally extending therefrom, such that said third finger member is substantially parallel to said laterally extending finger member, and such that said second finger member is located between said laterally extending finger member and said third finger member.

6. A clamp for securing end-of-train equipment to a railway coupler head, the railway coupler head having pre-existing core holes in the side thereof, at least two of the core holes being spaced vertically from each other and having a rib therebetween, said clamp comprising:

a housing;

a first finger member connected to said housing and protruding substantially perpendicularly therefrom, for insertion into an uppermost of the core holes, said first finger member having a lower abutting surface for resting atop the rib;

a second finger member having a first end, a second end, and an upper abutting surface for contacting an upper portion of said uppermost of the core holes, said second finger member being pivotally mounted to said housing adjacent said first finger member and between said first end and said second end, such that said first end of said second finger member is pivotable, about an axis that is substantially perpendicular to said first finger member and said second finger member, between a first position wherein said first end of said second finger member is substantially parallel to said first finger member for easy insertion and removal of said first and second finger members into said uppermost of the core holes, and a second position wherein said first finger member forms an acute angle with said second finger member; and pivoting means for forcibly pivoting said second finger member into forcible contact with said portion of said uppermost of the core holes.

7. The clamp according to claim 6, further comprising:

a third finger member connected to said housing and protruding substantially perpendicularly therefrom, such that said third finger member is substantially parallel to said first finger member, and such that said second finger member is located between said first and third finger member.

8. The clamp according to claim 7, further comprising:

an upper head abutting surface on said housing for contacting a portion of the railway coupler head adjacent to but exterior to and above said uppermost of the core holes.

9. The clamp according to claim 6, wherein said pivoting means comprises a threaded rod in cooperation with a threaded piston, said threaded rod being rotatable in a first direction which drives said piston off of said rod, and being rotatable in a second opposing direction which drives said piston onto said rod, said piston being connected to said second end of said second finger member so that rotation of said rod in said first direction urges said second end of said second finger downwardly relative to said first finger member, to pivot said first end of said second finger upwardly relative to said first finger member, and rotation of said rod in said second direction urges said second end of said second finger upwardly relative to said first finger member, to pivot said first end of said second finger downwardly relative to said first finger member.

10. A clamp for securing equipment to a railway coupler head, the railway coupler head having pre-existing core holes in the side thereof, at least two of the core holes being spaced vertically from each other and having a rib therebetween, said clamp comprising, comprising:

a housing;

scissors means connected to said housing, for gripping opposing internal surfaces of an uppermost of the core holes when inserted therewithin; and urging means connected to said scissors means, for forcibly urging said scissors means into forcible contact within said portion of said uppermost core hole.

11. The clamp according to claim 10, further comprising:

an upper head abutting surface on said housing, for contacting a portion of the railway coupler head adjacent to but exterior to and above said uppermost of the core holes.

12. The clamp according to claim 11, further comprising:

a lower head abutting surface on said housing, for contacting a portion of the railway coupler head adjacent to but exterior to and below said uppermost of the core holes.

13. The clamp according to claim 12, wherein said said scissors means further comprises:

a first finger member having an upper abutting surface for contacting a portion of said uppermost of the core holes;

second and third finger members laterally extending in parallel from said housing, each having a lower abutting surface for resting atop the rib;

said first finger member being pivotally mounted between said second and third finger member to pivot about a first axis extending substantially perpendicularly through said first, second and third finger members, thereby to pivot between a first position wherein said first, second and third finger member extend substantially in parallel to each other, for easy insertion into and removal from said uppermost of the core holes, and a second position wherein said lower abutting surfaces rest atop the rib while said upper abutting surface is forcibly urged to contact and press against said upper portion of said uppermost of said core holes.

14. The clamp according to claim 13, wherein said urging means comprises: a threadable member rotatable about a second axis that is substantially perpendicular to said first axis.

15. The clamp according to claim 13, wherein said first finger member forms an acute angle with said second and third finger members when in said second position.

16. The clamp according to claim 13, wherein said urging means comprises a threaded rod in cooperation with a threaded piston, said threaded rod being rotatable in a first direction which drives said piston off of said rod, and being rotatable in a second opposing direction which drives said piston onto said rod, said piston being connected to said first finger member so that rotation of said rod in said first direction pivots said first finger member upwardly relative to said second and third finger members, and rotation of said rod in said second direction pivots said first finger member downwardly relative to said second and third finger members.

17. The clamp according to claim 4, wherein said second finger member further comprises a slotted clevis for attachment to said threadable member.

18. The clamp according to claim 9, wherein said second finger member further comprises a slotted clevis for attachment to said threaded piston.

19. The clamp according to claim 14, wherein said first finger member further comprises a slotted clevis for attachment to said threadable member.

20. The clamp according to claim 16, wherein said first finger member further comprises a slotted clevis for attachment to said threaded piston.

* * * * *